US006461450B1

(12) United States Patent
Riesop et al.

(10) Patent No.: US 6,461,450 B1
(45) Date of Patent: Oct. 8, 2002

(54) METHOD FOR CONTROLLING THE COATING WEIGHT FOR STRIP-PHOSPHATING

(75) Inventors: Joerg Riesop, Kerpen; Franz-Gerd Ricke, Schweim; Frank Panter, Dortmund; Dieter Geruhn, Werl; Hubertus Peters, Dortmund; Manfred Wessel, Welver; Andreas Klare, Luenen, all of (DE)

(73) Assignees: Henkel Kommanditgesellschaft fur Aktien, Duesseldorf (DE); Thyssen Krupp Stahl AG, Duesseldorf (DE)

( * ) Notice: Subject to any disclaimer, the term of this patent is extended or adjusted under 35 U.S.C. 154(b) by 0 days.

(21) Appl. No.: 09/623,334

(22) PCT Filed: Feb. 20, 1999

(86) PCT No.: PCT/EP99/01108

§ 371 (c)(1),
(2), (4) Date: Feb. 16, 2001

(87) PCT Pub. No.: WO99/45171

PCT Pub. Date: Sep. 10, 1999

(30) Foreign Application Priority Data

Mar. 2, 1998 (DE) ..... 198 08 755

(51) Int. Cl.[7] ..... C23C 27/07
(52) U.S. Cl. ..... 148/262; 148/253; 148/260
(58) Field of Search ..... 148/253, 260, 148/262

(56) References Cited

U.S. PATENT DOCUMENTS

| | | | | |
|---|---|---|---|---|
| 4,497,668 A | | 2/1985 | Mady et al. | 148/6.15 |
| 4,670,066 A | | 6/1987 | Schapira et al. | 148/6.15 |
| 5,236,565 A | | 8/1993 | Muller et al. | 204/181.3 |
| 5,268,041 A | | 12/1993 | Gehmecker et al. | 148/260 |
| 5,516,372 A | | 5/1996 | Riesop et al. | 148/262 |
| 5,604,040 A | | 2/1997 | Sugama | 428/472.3 |
| 5,792,283 A | * | 8/1998 | Roland et al. | 148/260 |
| 6,068,709 A | | 5/2000 | Schapira et al. | 148/253 |

FOREIGN PATENT DOCUMENTS

| | | |
|---|---|---|
| CA | 2022728 | 2/2000 |
| DE | 35 37 108 | 4/1987 |
| DE | 42 28 470 | 3/1994 |
| DE | 42 41 134 | 6/1994 |
| DE | 196 39 596 | 4/1998 |
| DE | 197 40 953 | 3/1999 |
| EP | 0 111 246 | 6/1984 |
| EP | 0 287 133 | 10/1988 |
| EP | 0 315 059 | 5/1989 |
| EP | 0 414 296 | 2/1991 |
| EP | 0 459 541 | 12/1991 |
| EP | 0 653 502 | 5/1995 |
| EP | 0 826 792 | 3/1998 |
| FR | 2 569 203 | 2/1986 |
| JP | 62/020879 | 1/1987 |
| WO | WO91/02829 | 2/1986 |
| WO | WO95/07370 | 3/1995 |

OTHER PUBLICATIONS

Patent Abstracts of Japan, vol. 011, No. 200 (Jun. 1987).
Din 50942 (May 1987).

* cited by examiner

*Primary Examiner*—John Sheehan
*Assistant Examiner*—Andrew L. Oltmans
(74) *Attorney, Agent, or Firm*—Stephen D. Harper; Daniel S. Ortiz

(57) ABSTRACT

A process for controlling the layer weight during the phosphating of steel strip zinc-coated on one or both sides, using a phosphating solution which contains 1 to 6 g/l zinc ions and 10 to 30 g/l phosphate ions, characterized in that a Fe(II) ion content within the range of 3 to 100 mg/l is established in the phosphating solution. The higher the Fe(II) content, the lower is the layer weight. An alteration in the Fe(II) content of 3 to 20 mg/l results in an alteration in the layer weight of about 0.1 g/m$^2$.

6 Claims, No Drawings

METHOD FOR CONTROLLING THE COATING WEIGHT FOR STRIP-PHOSPHATING

This invention relates to a process for controlling the layer weight during the phosphating of steel strip zinc-coated on one or both sides. By this means the layer weights may be reliably maintained within the required range of from about 1 to about 2 g/m$^2$ even when the belt speed, hence the phosphating time, is altered or when other phosphating variables are altered.

Whenever steel strip zinc-coated on one or both sides is mentioned for the present purposes, this means both electrolytically zinc-coated and hot-dip zinc-coated steel strip. It also means steel strips coated with zinc alloy. In the latter, the zinc layer contains additional alloying constituents, such as iron, nickel and/or aluminum.

The term "layer weight" is frequently used in the field of metal surface phosphating. Instead of "layer weight" or, more fully, "phosphate layer weight", the terms "layer thickness" or "mass per unit area" are also used. By this is meant the mass per unit area of the metal phosphate layer produced on the metal surface by the phosphating. It is generally expressed in g/m$^2$. It may be determined by weighing a phosphated metal sheet having a known surface area, removing the metal phosphate layer and reweighing the metal sheet. The mass of the metal phosphate layer per m$^2$ may be calculated from the weight difference found, taking into account the surface area of the metal sheet. A 0.5 wt. % solution of chromic acid, for example, may be used to remove the metal phosphate layer. The method for determining the layer weight is described in more detail in German Standard DIN 50942.

The layer weight is an important variable for controlling the results of the phosphating. Layer weights within different ranges are sought, depending on the intended use of the phosphated metal parts. The present invention is concerned chiefly with sheet metal used in the manufacture of automobiles. Here layer weights of more than 0.8 g/m$^2$, but of about 4 g/m$^2$ at most, are sought. The layer weights are to be preferably less than 3 g/m$^2$ and in particular from about 1 to about 2 g/m$^2$.

Processes for phosphating surfaces of iron, steel, zinc and alloys thereof, as well as of aluminum and alloys thereof are long-standing prior art. The phosphating of the aforementioned surfaces serves to increase the adhesive strength of paint layers and to improve the corrosion protection. The phosphating is carried out by dipping the metal surfaces into the phosphating solutions or by spraying the metal surfaces with the phosphating solutions. Combined processes are also known. Formed metal parts, such as car bodies, may be phosphated, as may also metal strips on high-speed production lines. The present invention is concerned with such a phosphating of strip. Phosphating of strip differs from phosphating of parts in that, because of the high conveyor belt speeds the phosphating, i.e. the development of a closed metal phosphate layer, has to take place within a short period of time, for example, about 2 to about 20 seconds.

Processes for phosphating metal strips, in particular steel strips which have been zinc-coated electrolytically or by hot dipping, are known in prior art. For example, WO 91/02829 describes a process for phosphating steel strip which has been zinc-coated electrolytically and/or by hot dipping; the process involves short-term treatment with acidic phosphating solutions which, besides zinc ions and phosphate ions, contain manganese cations and nickel cations as well as anions of oxygen-containing acids having an accelerating action. The latter definition is to be understood as referring in particular to nitrate ions. DE-A-35 37 108 likewise describes a process for phosphating electrolytically zinc-coated steel strips by treatment with acidic phosphating solutions which, besides zinc ions, manganese ions and phosphate ions, contain other metal cations, such as nickel ions and/or anions of oxygen-containing acids having an accelerating action, in particular nitrate ions. Here the zinc cation content is within the relatively low range of 0.1 to 0.8 g/l.

German Patent Application DE-A 196 39 596 attempts to provide a phosphating process which, on the one hand, solves the problem of pinholing and, on the other hand, also renders it possible, within the short phosphating times usual on production lines, to produce a closed crystalline phosphate layer on steel strips which are not zinc-coated on either side and on the zinc-free side of steel strips zinc-coated on one side only. By "pinholes" are meant whitish corrosion points on the metal surface which have a crater-like appearance in micrographs. Such pinholes are frequently formed on zinc-coated steel surfaces when the phosphating solution has too high a content of chloride ions and/or nitrate ions. According to the abovementioned document, this object is achieved by a process for the phosphating of steel strip, or of steel strip coated on one or both sides with zinc or zinc alloy, by spray treatment or dipping treatment for a period within the range of 2 to 15 seconds, using an acidic phosphating solution containing zinc and manganese, at a temperature within the range of 40 to 70° C., characterised in that the phosphating solution contains:

- 1 to 4 g/l zinc ions
- 0.8 to 3.5 g/l manganese ions
- 10 to 30 g/l phosphate ions
- 0.1 to 3 g/l hydroxylamine in free, ionic or bound form and not more than 1 g/l nitrate ions, and has a free acid content within the range of 0.4 to 4 points and a total acid content within the range of 12 to 50 points.

DE-A 197 40 953 describes a process for the phosphating of steel strip, or of steel strip coated on one or both sides with zinc or zinc alloy, by spray treatment or dipping treatment for a period within the range of 2 to 20 seconds, using an acidic phosphating solution containing zinc, magnesium and manganese, at a temperature within the range of 50 to 70° C., characterised in that the phosphating solution is free from nitrate ions and in that it contains:

- 1 to 4 g/l zinc ions
- 1.2 to 4 g/l manganese ions
- 1 to 4 g/l magnesium ions
- 10 to 30 g/l phosphate ions
- 0.1 to 3 g/l hydroxylamine in free, ionic or bound form, and has a free acid content within the range of 0.4 to 4 points and a total acid content within the range of 15 to 45 points.

If in addition nickel ions are added to the phosphating solutions containing zinc and manganese, the so-called "trication phosphating solutions" are obtained.

The terms "free acid" and "total acid" are generally known in the field of phosphating. They are determined by titrating a sample from the acid bath with 0.1 N sodium hydroxide solution and measuring the consumption of the latter. The consumption in ml is expressed as a number of points. In this document, the number of points of free acid means the consumption in ml of 0.1 N sodium hydroxide solution required to titrate 10 ml of bath solution which has been diluted to 50 ml with deionised water, to a pH of 4.0. Similarly, the number of points of total acid gives the consumption in ml to attain a pH of 8.2.

Various methods of adjusting the layer weight to within the required range are known in prior art. For example, this may be achieved by altering the belt speed, the other bath variables remaining the same. Usually, however, a certain belt speed is preset, so that the phosphating bath variables have to be adjusted in such a way that they produce layer weights within the required range at the preset belt speed. Here the belt speeds may vary considerably and they may range, for example, between about 20 and about 180 m/min. Possible ways of regulating the layer weight known hitherto are: altering the temperature of the phosphating bath, altering the free acid, the total acid and/or the concentration of the layer-forming ions. However, the response to these alterations is only very slow, so that it takes considerable time for layer weights within the required range to be obtained. In this connection, it is particularly inconvenient to adjust the layer weight by altering the composition of the bath. These alterations may often only be reversed with considerable delay. At the least, they involve an additional consumption of phosphating chemicals and hence additional costs.

There is therefore a need for a process for adjusting the layer weight to within the required range, as rapidly as possible, reversibly and with as low a consumption of chemicals as possible, in particular with an alteration of the belt speed.

The present invention accordingly relates to a process for controlling the layer weight during the phosphating of steel strip zinc-coated on one or both sides, using a phosphating solution which contains 1 to 6 g/l zinc ions and 10 to 30 g/l phosphate ions, characterised in that a Fe(II) ion content within the range of 3 to 100 mg/l is established in the phosphating solution.

This process is based on the surprising observation that the more iron(II) ions the phosphating bath contains, the lower is the layer weight, the variables in the process apart from this being the same. In this connection it was observed that, for layer weights within the range given in the introduction, with other phosphating variables being the same, the layer weight is lowered by about 0.1 g/m$^2$, if between 3 and 20 mg/l, in particular about 5 to about 10 mg/l, iron(II) ions are added to the phosphating bath. A progressively smaller amount of iron(II) is sufficient, the longer the treatment time. Here the preferred procedure is to prepare a stock solution of a soluble iron(II) salt having a known iron concentration and to add this to the phosphating bath as required. The soluble iron(II) salts added are preferably salts of anions which do not adversely affect the result of phosphating or the corrosion protection. Iron(II) sulfate is particularly suitable for this.

The process according to the present invention thus renders it possible to counteract the increase in the layer weight which occurs when the belt speed is decreased, by increasing the concentration of iron(II) ions in the phosphating bath by about 3 to 20 mg/l, depending on the treatment time, in order to achieve a lowering of the layer weight by 0.1 g/m$^2$. At concentrations of iron(II) ions within the range of between about 3 and about 100 mg/l, preferably between about 10 and about 100 mg/l and in particular between about 15 and about 55 mg/l, and at belt speeds within the range of about 20 and about 180 m/min and resulting phosphating times of about 2 to about 15 seconds, layer weights within the range of between about 1 and about 2 g/m$^2$ are reliably obtained. If, on a further alteration of the variables in the process, for example, on an increase in the belt speed and associated therewith a shortening of the phosphating time, an excessively low layer weight is to be counteracted, the appropriate quantity of iron(II) ions has to be removed from the phosphating bath. To increase the layer weight by about 0.1 g/m$^2$, between about 3 and about 20 mg/l, in particular about 5 to about 10 mg/l, iron(II) ions, depending on the treatment time, has to be withdrawn from the phosphating bath. This may be effected most easily by adding to the phosphating bath an oxidising agent in the amount calculated to oxidise the required quantity of iron(II) ions to iron(III) ions. The latter are precipitated as iron(III) phosphate, so that the influence thereof on the layer weight disappears.

The process according to the present invention is preferably operated so that the phosphating solution is replenished with supplementary solutions which contain no iron (II). The result of this is that, owing to dragging out or atmospheric oxidation, the iron(II) content of the phosphating bath decreases with time, so that the layer weights increase with time. This effect may be desirable, provided that the layer weight is within the technically preferred range. An undesirable further increase may be counteracted by adding the appropriate quantity of iron(II) ions to the phosphating bath.

Phosphating solutions which, besides zinc ions, contain in addition ions of one or more other divalent metals are at present in use for the phosphating of zinc-coated steel strips. In particular, phosphating baths at present in use are those containing in addition one or more of the following cations: 1 to 5 g/l manganese ions, 1 to 4 g/l magnesium ions, 0.8 to 4.5 g/l nickel ions. The process according to the present invention may also be used in such baths.

In addition to the above-mentioned layer-forming cations, the phosphating solutions also contain alkali metal cations and/or ammonium cations in order to adjust the level of the free acid to within the required range.

Phosphating baths usually contain in addition so-called accelerators. These are substances which react with the hydrogen produced at the metal surface during the pickling reaction. In this way they prevent a so-called polarisation of the metal surface as a result of covering with hydrogen. The accelerators thereby enhance the even covering of the metal surface with fine phosphate crystals, which are generally of a size between about 1 and about 10 $\mu$m. The process according to the present invention presupposes that accelerators which oxidise iron(II) to iron(III) will be avoided. Hydroxylamine in particular presents itself as an accelerator which does not oxidise iron(II). Accordingly, the use of a phosphating solution containing in addition as an accelerator about 0.1 to about 3 g/l hydroxylamine in free, ionic or bound form is preferred for the process according to the present invention.

Hydroxylamine may be used as free base, as a hydroxylamine-releasing compound, such as hydroxylamine complexes, and as ketoximes or aldoximes or in the form of hydroxylammonium salts. If free hydroxylamine is added to the phosphating bath or to a phosphating bath concentrate, it will be present largely in the form of hydroxylammonium cations owing to the acidic character of these solutions. If it is used in the form of a hydroxylammonium salt, the sulfates and the phosphates are particularly suitable. In the case of the phosphates, the acid salts are preferred owing to the better solubility thereof. In order, on the one hand, to take account of economic aspects and, on the other hand, not to load the phosphating baths with excessive sulfate ions, a combination of free hydroxylamine and hydroxylammonium sulfate may be used with advantage. Hydroxylamine or its compounds are added to the phosphating solution in quantities such that the calculated concentration of the free hydroxylamine is between about 0.1 and about 3 g/l, preferably between about 0.15 and about 1 g/l.

For the purpose of stating the phosphate concentration, the total phosphorus content of the phosphating bath is regarded as being present in the form of phosphate ions $PO_4^{3-}$. Accordingly, in the calculation or determination of the concentration, no consideration is given to the known fact that, at the acidic pH values of the phosphating baths, which are within the range of about 2.0 to about 3.6, only a very small proportion of the phosphate is actually present in the form of the triply negatively charged anions. At these pH values, it is rather to be expected that the phosphate exists chiefly as a singly negatively charged dihydrogen phosphate anion, together with undissociated phosphoric acid and with smaller quantities of doubly negatively charged hydrogen phosphate anions.

The phosphating of steel strips zinc-coated by hot dipping is facilitated by fluoride ions and even for the phosphating of electrolytically zinc-coated steel strip the presence of fluoride ions may be advantageous for an even layer formation. Accordingly, another preferred embodiment of the present invention involves using phosphating solutions which contain up to about 0.8 g/l fluoride in free or in complexed form. For example, for phosphating electrolytically zinc-coated steel strip, the preferred fluoride contents are within the range of 0.0 to about 0.5 g/l and in particular within the range of about 0.1 to 0.2 g/l.

The phosphating solutions are generally prepared in the manner known to the person skilled in the art. Phosphate is introduced into the phosphating solutions, for example, in the form of phosphoric acid. The cations are added to the phosphoric acid in the form of acid-soluble compounds such as the carbonates, the oxides or the hydroxides, so that the acid is partly neutralised. The further neutralisation to within the required pH range is carried out preferably by addition of sodium hydroxide or sodium carbonate. A suitable source of free fluoride anions is, for example, sodium fluoride or potassium fluoride. Tetrafluoroborate or hexafluorosilicate, for example, may be used as complex fluorides.

To produce phosphate layers having a layer weight within the required range, it is preferable to use phosphating solutions having a free acid content within the range of about 0.4 to about 4 points and a total acid content within the range of about 15 to about 45 points. The terms "free acid" and "total acid" and the methods for determining them have already been described. The values of the free acid are preferably between about 1.5 and about 3.5 and in particular between about 2.0 and about 3.0 points. The total acid content is preferably within the range of about 25 to about 35 points.

The temperature of the phosphating solution in the process according to the present invention is preferably within the range of about 50 to about 70° C. and in particular between 53 and 65° C.

In the process according to the present invention, the steel strip zinc-coated on one or both sides is brought into contact with the phosphating solution for a period within the range of about 2 to about 30 seconds by spraying the phosphating solution onto the zinc-coated steel strip or by dipping the zinc-coated steel strip into the phosphating solution. Here the spray treatment is easier to carry out technically and is therefore preferred. Treatment times between 3 and 15 seconds are particularly preferred. After the required treatment time, the phosphating solution is removed from the zinc-coated steel strip by rinsing with water.

The process according to the present invention presupposes that the introduction of iron(II) ions into the phosphating solution will not be uncontrolled. As already mentioned, supplementary solutions which contain no iron(II) are therefore preferred. Furthermore, in the phosphating of steel strip zinc-coated on one side only, measures should be taken to prevent the steel side which is not coated with zinc from coming into contact with the phosphating solution and with this the entry of iron(II) ions into the phosphating solution through a pickling reaction. Accordingly, in the case of the phosphating of steel strip zinc-coated on one side, the process according to the present invention is carried out in such a way that only the zinc-coated side of the strip is brought into contact with the phosphating solution. Thus by suitable technical measures, such as covering the strip side which is not zinc-coated, contact of the latter with the phosphating solution is avoided.

The process according to the present invention is preferably used for producing phosphate layers having layer weights within the range of 1 to 2 g/m$^2$. In particular, the content of iron(II) ions in the phosphating bath is adjusted so that layer weights of 1.5±0.3 g/m$^2$ are obtained. The content of iron(II) ions may be controlled by known analytical techniques and particularly easily by dipping appropriate commercially available measuring strips into the treatment solution.

Before the phosphating solution is applied, the metal surface must be completely wettable with water. This is found as a rule on continuously operating production lines. Should the belt surface be oiled, however, this oil must be removed by means of a suitable cleaning agent before the phosphating. Methods for this are common in the industry. Before the phosphating, an activation is conventionally carried out by means of known activating agents. Generally solutions or suspensions which contain titanium phosphates and sodium phosphates are used. The activation is followed by the application of the phosphating process according to the present invention, which is advantageously followed by a passivating secondary washing. Here an intermediate washing with water generally takes place between phosphating and passivating secondary washing. Treatment baths containing chromic acid are widely used for passivating secondary washing. On grounds of industrial safety and environmental protection and for reasons associated with toxic waste disposal, there is, however, a tendency to replace these chromium-containing passivating baths with chromium-free treatment baths. For this purpose, purely inorganic bath solutions, in particular those based on hexafluorozirconates, or even organic reactive bath solutions, for example, based on substituted poly(vinylphenols) are known. One may also use secondary washing solutions containing 0.001 to 10 g/l of one or more of the following cations: lithium ions, copper ions, silver ions and/or bismuth ions.

The metal strips phosphated according to the present invention may be coated directly with an organic coating. Even in the initially uncoated state they may, however, after cutting, forming and joining, be assembled to form structural parts, such as car bodies or domestic appliances. The forming processes associated with this are facilitated by the phosphate layer. If the corrosive stress on the finished structural parts is low as, for example, in the case of domestic appliances, the appliances assembled from the previously phosphated metal may be directly coated. For higher corrosion-prevention standards, such as are set in automobile construction, it is advantageous for another phosphating treatment to be carried out following the assembly of the car bodies.

EXAMPLES

The process according to the present invention for controlling the layer weight was tested on a production line for the phosphating of steel electrolytically zinc-coated on both sides. The electrolytically zinc-coated metal strips, after having been zinc-coated, were activated with an activating solution containing titanium phosphate (Fixodine®950, Henkel KGaA, batch concentration 0.5 wt. %) and phosphated under the conditions given in the Table below. In addition to the values given in the Table, the phosphating bath in this Example had the following composition:

3.5 g/l zinc, 3.0 g/l manganese, 3.0 g/l nickel, 17 g/l phosphate ions, 15 g/l nitrate ions The values correspond to the commercially used phosphating system GRANODINE® 5854 (Henkel KGaA).

TABLE

Influence of the iron(II) content on the layer weight

| | Belt speed m/min | Treat-ment time sec- | Free acid points | Total acid points | Temp-erature ° C. | Fe(II) content mg/l | Layer weight g/m$^2$ |
|---|---|---|---|---|---|---|---|
| Comp. 1 | 45 | 12 | 2.5 | 30 | 58 | ≈0 | 2.0 |
| Ex. 1 | 45 | 12 | 2.5 | 30 | 58 | 20 | 1.7 |
| Ex. 2 | 45 | 12 | 2.5 | 30 | 58 | 35 | 1.4 |
| Comp. 2 | 90 | 6 | 2.5 | 30 | 58 | ≈0 | 1.7 |
| Ex. 3 | 90 | 6 | 2.5 | 30 | 58 | 20 | 1.5 |
| Comp. 3 | 180 | 3 | 2.5 | 30 | 58 | ≈0 | 1.2 |
| Ex. 4 | 180 | 3 | 2.5 | 30 | 58 | 20 | 1.1 |

What is claimed is:

1. A process for adjusting a coating weight during the phosphating of steel strip zinc-coated on one or both sides which comprises contacting said zinc side of said steel strip for from 2 to 30 seconds with a phosphating solution that comprises:

(A) from 1 to 6 g/l of zinc ions;

(B) from 10 to 30 g/l of phosphate ions;

(C) from 3 to 100 mg/l of Fe(ii) ions, and (D) at least one source of hydroxylamine and all sources of hydroxylamine present have a stoichiometric equivalent hydroxylamine that is from 0.1 g/l to about 3 g/l, said adjusting being accomplished by adding to said phosphating solution from 3 to 20 mg/l of Fe(II) ons in order to reduce the layer weight by 0.1 g/m$^2$ or by removing from said phosphating solution from 3 to 20 mg/l of Fe(II) ions in order to increase the layer weight by 0.1 g/m$^2$, other phosphating variables remaining the same when the Fe(II) ions are added or removed to provide the coating in a weight of 1 to 2 g/m$^2$ and wherein the phosphating solution does not contain accelerators which oxidize Fe(II) and Fe(III).

2. A process according to claim 1, wherein the phosphating solution additionally comprises at least one component selected from the group consisting of:

from 1 to 5 g/l of manganese cations;

or from 1 to 4 g/l of magnesium cations; and from 0.8 to 4.5 g/l of nickel cations.

3. A process according to claim 1, wherein the phosphating solution has a free acid content within the range of 0.4 to 4 points and a total acid content within the range of 15 to 45 points.

4. A process according to claim 1, wherein the phosphating solution during its contact with the steel strip has a temperature within a range of 50 to 70° C.

5. A process according to claim 2, wherein the phosphating solution has a free acid content within the range of 0.4 to 4 points and a total acid content within the range of 15 to 45 points.

6. A process according to claim 5, wherein the phosphating solution during its contact with the steel strip has a temperature within a range of 50 to 70° C.

* * * * *